US005823007A

United States Patent [19]

Chang

[11] Patent Number: 5,823,007

[45] Date of Patent: Oct. 20, 1998

[54] COLD/HOT WATER DISPENSER HAVING AN EXPANSION TANK FOR WATER OVERFLOW

[75] Inventor: Beung-Kwon Chang, Suwon, Rep. of Korea

[73] Assignee: Samsung Electronics Co., Ltd., Suwon, Rep. of Korea

[21] Appl. No.: 851,029

[22] Filed: May 5, 1997

[30] Foreign Application Priority Data

May 25, 1996 [KR] Rep. of Korea ..... 96-17908

[51] Int. Cl.[6] ..... B67D 5/62

[52] U.S. Cl. ..... 62/397; 62/389; 222/146.1; 222/64

[58] Field of Search ..... 62/389, 390, 391, 62/397; 222/146.1, 146.5, 146.6, 64

[56] References Cited

U.S. PATENT DOCUMENTS 3,381,110 4/1968 Fischer ..... 222/146.1
3,891,124 6/1975 Dreibelbis ..... 222/66
4,007,856 2/1977 Murphy et al. ..... 222/67
4,513,887 4/1985 Wicke et al. ..... 222/146.5

*Primary Examiner*—William Doerrler
*Attorney, Agent, or Firm*—Burns, Doane, Swecker & Mathis, L.L.P.

[57] ABSTRACT

A water dispenser includes a storage tank for receiving purified water, and supplying the water to hot and cold water tanks disposed beneath the storage tank. Dispensing valves are connected to the hot and cold water tanks for dispensing water therefrom. A water level detector is provided for maintaining a water level in the storage tank at a predetermined first elevation. An expansion tank has an outlet and inlet situated at a second elevation disposed above the first elevation. The inlet of the expansion tank communicates with the top of the hot water tank so that the presence of water in the storage tank situated above the second elevation forces water to flow from the hot water tank and through the expansion tank. Also, excess water in the hot water tank caused by thermal expansion is forced through the expansion tank.

9 Claims, 6 Drawing Sheets

COLD/HOT WATER DISPENSER HAVING AN EXPANSION TANK FOR WATER OVERFLOW

BACKGROUND OF THE INVENTION

1. Field of the Invention

The present invention relates to a cold/hot water dispenser for easily discharging hot water volume-expanded in a hot water tank as well as for controlling water level of a purified water storage tank.

2. Description of the Prior Art

According to a prior art cold/hot water dispenser, a water purifying chamber E having a purified water storage tank 3 therein, as illustrated in FIGS. 1 to 3, is formed in a body 1. A cold and hot water chamber H is formed below the water purifying chamber E and has a cold water tank 7 and a hot water tank 9 therein in which purified water from the purified water storage tank 3 is transformed respectively to cold water and hot water and is stored. A filtering chamber G is formed behind the cold and hot water chamber H and has a plurality of filtering members 12 therein for purifying tap water provided from a water faucet (not shown). An operation chamber F is formed below the cold and hot water chamber H and the filtering chamber G and has a cooling system for transforming the purified water to cool water. A control chamber I is formed below the cold and hot water chamber H and has various electronic devices arranged therein.

In the filtering chamber G, a sterilizer 13 is installed for sterilizing harmful bacteria contained in the filtered water passing through the plurality of filtering members 12. And a compressor 15 is installed below the sterilizer 13 for increasing the pressure of the filtered water to transmit the water through the filters 12.

In the operation chamber F, there is installed at the front thereof a compressor 50 for compressing a refrigerant of low pressure and low temperature to that of high pressure and high temperature. A fan 19 is located at the rear of the compressor 17 for condensing the refrigerant and for cooling the compressor 17 at the same time. A motor 21 rotates the fan 19. And a condenser 23 is located at the rear of the motor 21 and is connected with the compressor 17 by a refrigerant pipe not shown for condensing high pressure and high temperature refrigerant gas received from the compressor 17 to refrigerant liquid.

In the hot water tank 9, there is a heater 25 installed for heating the purified water supplied by a first outlet pipe 24 from the purified water storage tank 3. A hot water supplying pipe 29 is attached on a lateral surface of the hot water tank 9 via a hot water supply valve 27. A ventilating pipe 28 is installed at a side of the hot water tank 9 for facilitating the discharge of hot water through the hot water supply valve 27 by conducting air into the hot water tank 9 and at the same time for conducting an outflow of hot water when the volume thereof is expanded excessively, and an end of the ventilating pipe 28 is connected with an upper end of the purified water storage tank 3 so that hot water conducted through the pipe 28 can flow into the purified water storage tank 3.

Around the cool water tank 7, there is an evaporator 33 installed for cooling the purified water supplied by a second outlet pipe 31 from the purified water storage tank 3. A cool water supplying pipe 37 is attached on a lateral surface of the cool water tank 7 via a cool water supply valve 35. A ventilating pipe 44 is installed at a side of the cool water tank 7 for facilitating the discharge of cool water tank 7 by conducting air into the cool water tank 7.

A cover member 39 is screw-coupled on the purified water storage tank 3 for enabling the inside of the tank 3 to be cleaned, and water level detecting means 41 is installed at a lateral side of the cover member 39 for detecting the water level in the tank 3. Ventilating holes 3*c* and 39*a* are formed beside the water level detecting means 41 or at a side of the cover member 39 for permitting the purified water stored in the purified water storage tank 3 to flow into the cool and hot water tanks 7 and 9 by admitting air into the tank 3. That air is also able to flow into the hot water tank 9 via the ventilating pipe 28. A purified water supply pipe 43 is installed at a lateral side of the purified water storage tank 3 for providing the purified water storage tank 3 with the filtered water passing through the sterilizer 13.

Numerals 45, 47, 49 and 51 indicate partition members for enclosing respectively the water purifying chamber E, the cool and hot water chamber H, the filtering chamber G, the operation chamber F, and the control chamber I, and at the same time for supporting various elements thereon. The numeral 53 indicates an operation panel for establishing a start and stop of the cool/hot purifier, and a temperature of water, and the numeral 55 indicates a water retainer for preventing water leakage out of the body 1 in case that the discharged water overflows a cup held by a user who operates the cold and hot water valves 35 and 27 to get water. The numeral 57 indicates a bracket member for fixing the filter means 12, and the numeral la indicates discharging holes where the hot air is discharged outward after cooling the condenser 23.

In a cold/hot water purifier thus constructed, when a switch provided at the control panel 53 is manipulated, the compressor 100 operates, whereby fresh water is supplied from a faucet and flows successively through the plurality of filtering members 12 to be filtered, and the pressure of water during passage through the filtering members 12 is maintained by the compressor 15.

The filtered water passing successively through various filtering members 15 is supplied into the purified water storage tank 3 via the purified water supply pipe 43 after being sterilized in the sterilizer 13 and, then, the finally purified water is stored respectively in the cold water tank 7 and the hot water tank 9. At this time, air is provided through the ventilating holes 3*c* formed on the purified water storage tank 3 to facilitate the outflow of the purified water.

At the same time, the compressor 17 and the motor 21 are operated and the gaseous refrigerant passing the compressor 17 is condensed in the course of passing through the condenser 60. At this time, the fan 19 is revolved by the motor 19 and blows air around the condenser 23 and the compressor 17 to liquidity the refrigerant flowing in the condenser 23 and at the same time to cool the compressor 17 and then flows out to the outside through the outlet holes 1*a*.

The liquid refrigerant of high pressure flows from the condenser 23 into a capillary tube (not shown) and is changed to liquid refrigerant of low pressure by the effects of adiabatic expansion in the capillary tube and then flows into the evaporation tube 33 installed at a side of the cold water tank 7. The refrigerant vaporized while passing through the evaporation pipe 33 flows as a gas into the compressor 31 and is changed to high temperature and high pressure. Thus, the refrigerant repeats a cycle thereof.

Further, electric power is applied to the heater 25 installed in the hot water tank 9 by electric power supply means not shown, and the heat generated in the heater 25 is applied to the purified water stored in the hot water tank 9 so that the purified water stored in the hot water tank 9 is heated.

Next, when the purified water reaches a predetermined height in the purified water tank 3 and the temperature of the cold water and the hot water respectively in the cold water tank 7 and the hot water tank 9 become a pre-determined temperature, the operation of the compressor 15 and the heater 25 is stopped according to signals from a water level sensor and a temperature sensor (not shown), and at the same time the refrigerant circulation cycle is also stopped.

Meanwhile, when a user wants to dispense hot or cold purified water into a vessel such as cup (not shown), he or she uses the vessel to push the hot water or cold water disposal valve 27 or 35 to discharge the hot water or cold water. At this time, air is provided to the cold water tank 7 through the ventilating pipe 44, and the air provided through ventilating holes 3*c* of the purified water storage tank 3 is discharged through a ventilating pipe 28 into the hot water tank 9, so that the discharging of the cold water and hot water is facilitated. During the water receiving operation proceeds as above, water leakage is prevented because water overflowing the user's hand-held cup is gathered in the water retainer 55.

However, there is a problem in a water dispenser according to the prior art thus constructed, that the ventilating pipe 28 enables hot water to flow into the purified water storage tank 3 to increase the cooling requirements in the cold water tank 7.

SUMMARY OF THE INVENTION

Accordingly, the present invention is provided to solve the aforementioned problem and it is an object of the present invention to provide a cold/hot water dispenser which can discharge easily excess hot water caused by volume expansion in the hot water tank and to discharge excess water in the purified water storage tank.

To accomplish the object of the present invention, there is provided a cold/hot water dispenser, the dispenser including an expansion tank installed at location higher than the highest water level of the purified water storage tank for maintaining the water level of the purified water storage tank at a predetermined water level.

BRIEF DESCRIPTION OF THE DRAWINGS

For a fuller understanding of the nature and object of the invention, reference should be made to the following detailed description taken in conjunction with the accompanying drawings in which.

DETAILED DESCRIPTION OF THE PREFERRED EMBODIMENT

Figure 1:
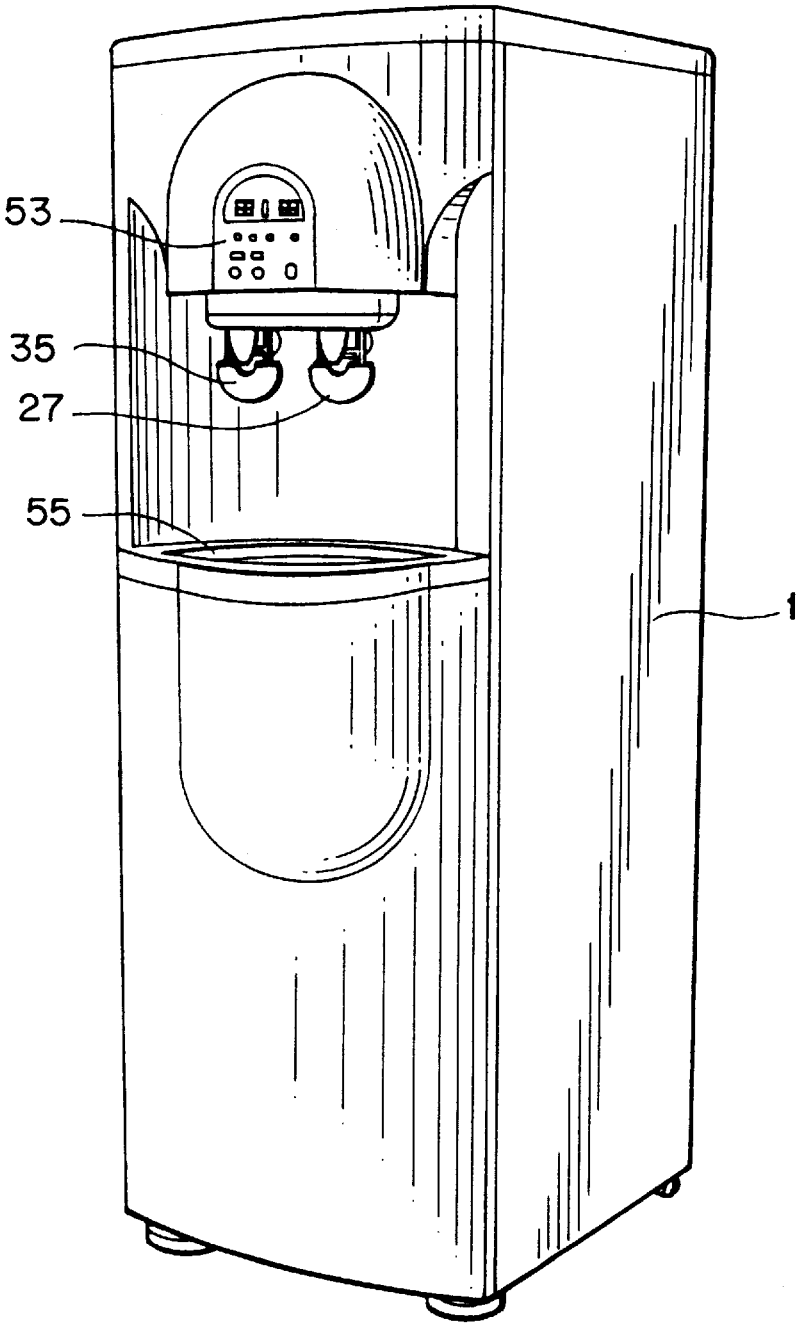
FIG. 1 (PRIOR ART)
FIG. 1 is a perspective view for illustrating a cold/hot water dispenser according to the prior art.
Figure 2:
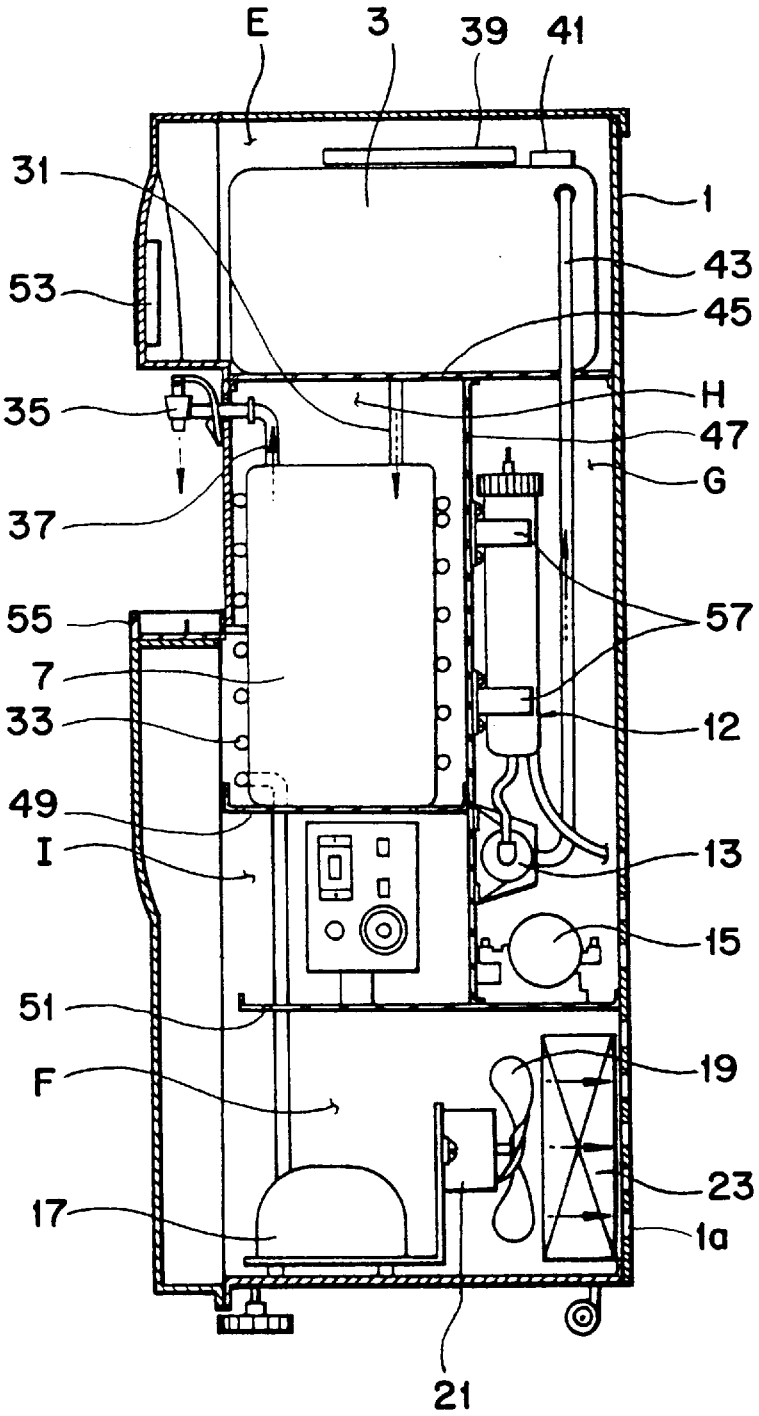
FIG. 2 (PRIOR ART)
FIG. 2 is a sectional side view for illustrating a side surface of a cold/hot water dispenser according to the prior art.
Figure 3:
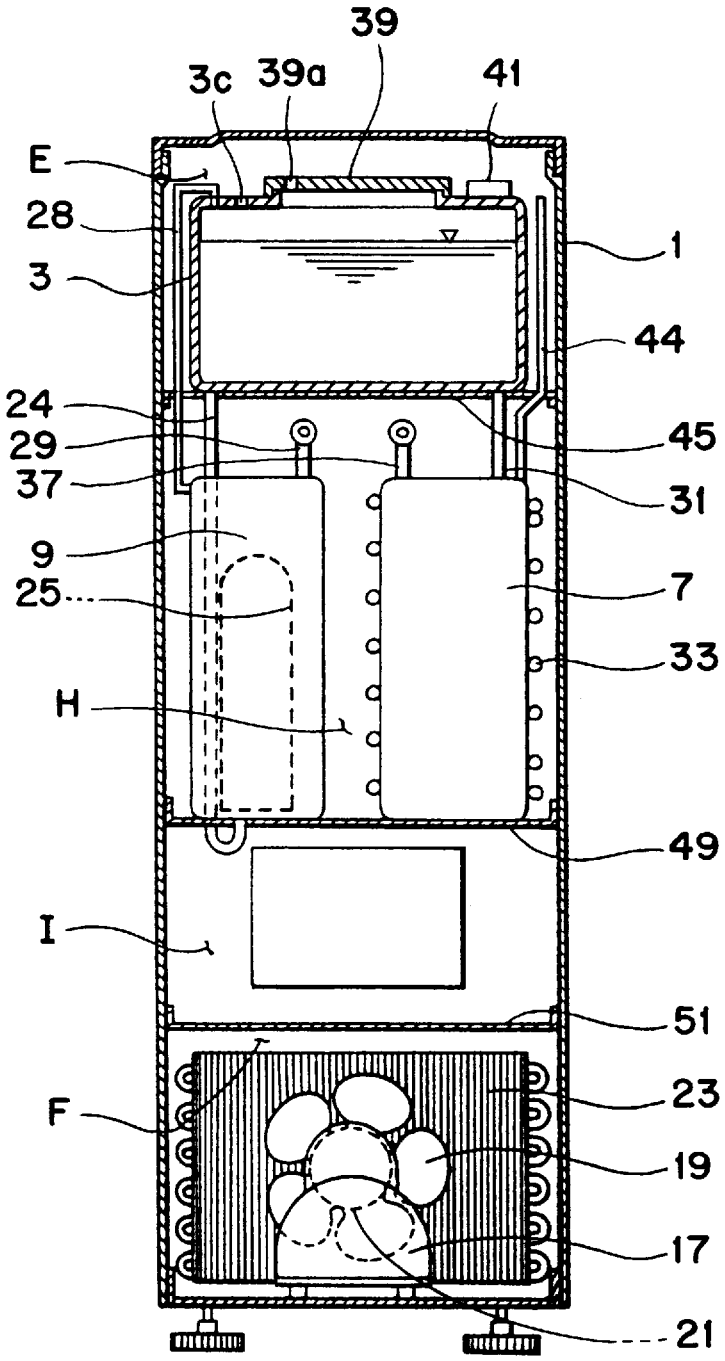
FIG. 3 (PRIOR ART)
FIG. 3 is a sectional rear view for illustrating a cold/hot water dispenser according to the prior art.

A cold/hot water dispenser according to the preferred embodiment of the present invention will now be described in detail with reference to FIGS. 4 to 6. Throughout the drawings, like reference numerals are used for the designation of like or equivalent parts in FIGS. 1 to 3 for simplicity of illustration and explanation, so another detailed description thereof will be omitted.

Figure 4:
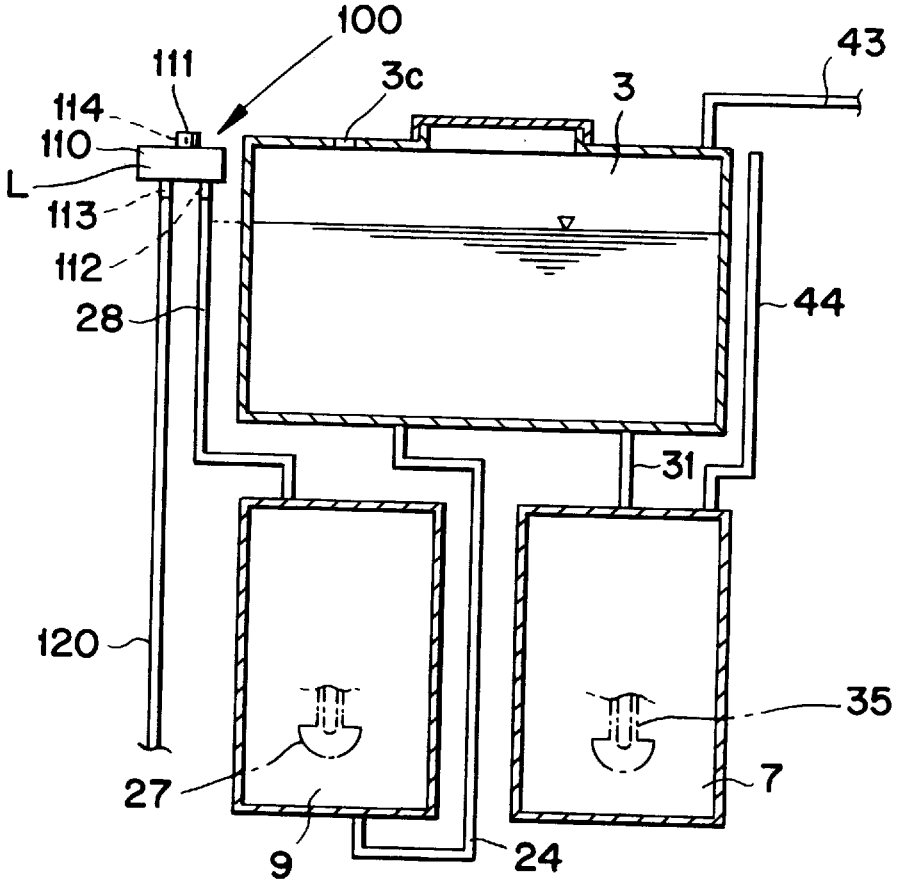
FIG. 4 is a schematic view of the water tanks and pipes of a cold/hot water dispenser according to an embodiment of the present invention.
Figure 5:
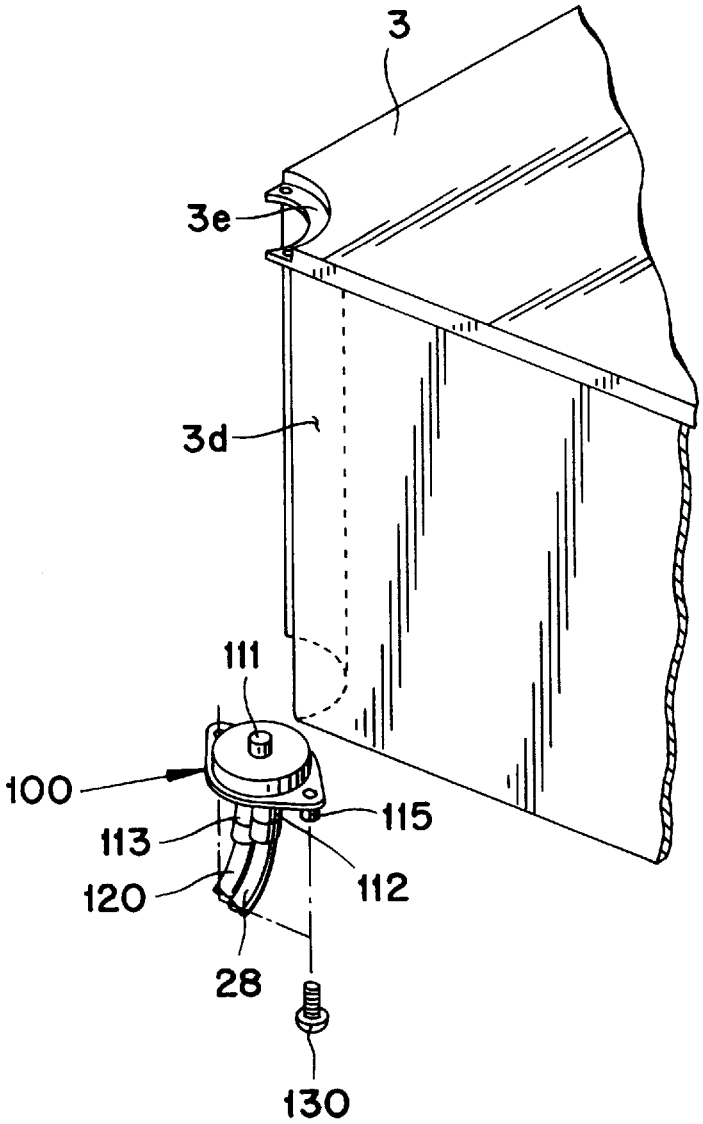
FIG. 5 is an exploded perspective view showing a disposition of an expansion tank in the cold/hot water dispenser according to the embodiment of the present invention.
Figure 6:
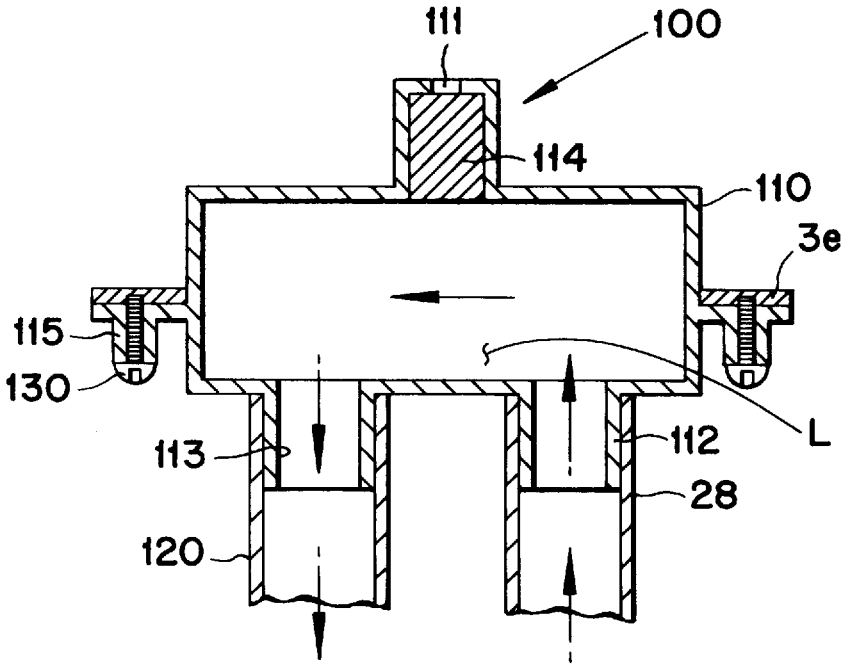
FIG. 6 is a cross sectional view showing the expansion tank according to an embodiment of the present invention.

As shown in FIGS. 4 to 6, a cold/hot water dispenser according to an embodiment of the present invention has a purified water storage tank 3 installed at a location for storing the purified water filtered by filtering members (not shown). A cold water tank 7 and a hot water tank 9 are installed below the purified water storage tank 3 for receiving the purified water from the purified water storage tank 3 and changing the purified water to a cold water and a hot water. A first outlet pipe 31 is disposed between the purified water storage tank 3 and the cold water tank 7 so that the purified water can flow easily into the tank 7, and a second outlet pipe 24 is disposed between the purified water storage tank 3 and the hot water tank 9 so that the purified water can flow easily into the hot water tank 9. Cold water and hot water dispensing valves 35 and 27 are installed respectively at a side of the cold water tank 7 and the hot water tank 9 for dispensing water. Ventilating pipes 28 and 44 are connected to the cold water tank 7 and the hot water tank 9, respectively, for supplying air to the cold water and hot water tanks 7 and 9 in order to facilitate the water dispensing. A small sized expansion tank 100 is installed at a location higher than the highest water level in the purified water storage tank 3. The tank 100 is mounted at a side of the purified water storage tank 3 for discharging easily the hot water rising along the ventilating pipe 28 of the hot water tank 9 according to a thermal volume expansion and at the same time for facilitating the dispensing of water from the hot water tank 9 by passing air thereto, and also for preventing the purified water from exceeding a predetermined level in the storage tank.

The expansion tank 100 (see FIG. 6) has a body 110 forming a water passage L therein. A ventilating hole 111 is formed at a top side of the body 100 for passing air. An inlet 112 is formed at the lower side of the body 100 for supplying air into the hot water tank 9 or for conducting an overflow of hot water from the hot water tank 9 into the inlet 112. An outlet 113 is formed in the lower side next to the inlet 112 for discharging that overflowing hot water outside of the dispenser. A discharging pipe 120 is fitted to the outlet 113 for discharging the overflowed hot water from the dispenser. A moisture absorbing member 114 such as sponge, cotton etc. is disposed in the apertured body 110 for filtering vapor contained in the air discharged when hot water ascends in the body 110. A fixing unit 115 is formed at a side of the body 110, and a screw 130 is provided for fixing the body 110 to the tank 3. The inlet 112 and the outlet 113 are formed at the same height (elevation) so that the hot water from the inlet 112 can be easily reversed in direction through the outlet 113.

An accommodation groove 3*d* (FIG. 5) for fixing the expansion tank 100 to the tank 3 is formed long along the purified water storage tank 3. The ventilating pipe 28 and the discharging pipe 120 are disposed in the accommodation groove 3*d*. The expansion tank 100 is coupled with a flange 3*e* formed in the accommodation groove 3*d* of the purified water storage tank 3 to complete the square shape of the top of the purified water storage tank 3.

In FIG. 4, the numeral 43 indicates a purified water supply pipe for conducting the purified filtered water from the filtering members into the purified water storage tank 3, and the numeral 3*c* indicates a ventilating hole for passing air into the purified water storage tank 3 so that the purified water stored in the purified water storage tank 3 can flow smoothly to the cold and hot water tanks 7 and 9.

Now, the operation and effects of the cold/hot water dispenser thus constructed according to the present invention will be described.

The purified water filtered by the filtering members (not shown) flows into the purified water storage tank 3 through the purified water supply pipe 43, and the purified water stored in the purified water storage tank 3 is provided respectively to the cold and hot water tanks 7 and 9 through the first and second outlet pipes 31 and 24. At this time, air is provided through the ventilating hole 3*c* formed on the purified water storage tank 3 and the air lets the purified water stored in the purified water storage tank 3 flow smoothly to the cold and hot water tanks 7 and 9.

As described above, the purified water provided to the cold and hot water tanks 7 and 9 is changed respectively to cold water and hot water by an evaporator and a heater (not shown), and a user receives the cold water and hot water by manipulating the cold and hot water dispensing valves 27 and 35. At this time, the air ventilated through the ventilation pipe 44 formed at a side of the cold water tank 7 facilitates discharge of the cold water. Air is also communicated with the hot water tank 9 through the ventilation pipe 28 and the expansion tank 100. That is, the air enters via the ventilation hole 111 of the body 110 to facilitate discharge of the hot water. Meanwhile, hot water flows to the outlet 113 through the water passage L formed within the body 110 when the hot water is volume-expanded in the hot water tank 9 and overflows through the ventilation pipe 28; the hot water from the outlet 113 is discharged out of the dispenser through the discharge pipe 120. At this time, the moisture absorbing member 114 filters-out vapors generated by the hot water, so that water leakage through the ventilation hole 111 is prevented.

Further, if excess water is present in the tank 3, causing the water level in the purified water storage tank 3 to become higher than the elevation A of the upper end of the ventilation pipe 28, the excess purified water in the purified water storage tank 3 overflows via pipes 24 and 28 and the discharge pipe 120.

As is apparent from the foregoing, there is an advantage in the cold/hot water dispenser according to the present invention in that the hot water overflow caused by volume expansion of heated water in the hot water tank can be discharged; the hot water tank is ventilated; and the water level in the tank 3 is prevented from exceeding a predetermined water level, so that the expansion tank can be made compact.

What is claimed is:

1. A water dispenser comprising:

a purified water storage tank;

a hot water tank disposed below the storage tank and communicating therewith for receiving water from the storage tank and heating that water;

a cold water tank disposed below the storage tank and communicating therewith for receiving water from the storage tank and cooling that received water;

a dispensing structure communicating with the hot and cold water tanks for dispensing water therefrom;

a water level detector for maintaining a water level at a predetermined first elevation in the storage tank; and an expansion tank for discharging excess water, said expansion tank having an inlet communicating with the hot water tank for receiving excess water therefrom, and a discharge outlet communicating with the inlet for discharging the excess water from the expansion tank, the inlet and outlet both situated at a same second elevation disposed above the first elevation, whereby excess water disposed in the storage tank above the second elevation forces water to flow from hot water tank and through the expansion tank.

2. The water dispenser according to claim 1 wherein the expansion tank includes a vent hole arranged for venting both the expansion tank and the hot water tank.

3. The water dispenser according to claim 2 further including a moisture absorbing member extending across the vent hole for filtering water vapor contained in hot water received from the hot water tank.

4. The water dispenser according to claim 2 wherein the inlet and outlet are disposed in a bottom wall of the expansion tank.

5. The water dispenser according to claim 4 wherein the vent hole is formed in a top wall of the expansion tank.

6. The water dispenser according to claim 1 wherein the expansion tank is mounted on the storage tank.

7. The water dispenser according to claim 1 wherein the hot water tank communicates with the inlet of the expansion tank by a conduit extending from a top wall of the hot water tank.

8. A water dispenser comprising:

a purified water storage tank;

a hot water tank disposed below the storage tank and communicating therewith for receiving water from the storage tank and heating that water;

a cold water tank disposed below the storage tank and communicating therewith for receiving water from the storage tank and cooling that received water;

a dispensing structure communicating with the hot and cold water tanks for dispensing water therefrom;

a water level detector for maintaining a water level at a predetermined first elevation in the storage tank; and an expansion tank for discharging excess water, said expansion tank having an inlet communicating with the hot water tank for receiving excess water therefrom, and a discharge outlet communicating with the inlet for discharging the excess water from the expansion tank, the inlet situated at a second elevation disposed above the first elevation, whereby excess water disposed in the storage tank above the second elevation forces water to flow from hot water tank and through the expansion tank, wherein the expansion tank includes a vent hole arranged for venting both the expansion tank and the hot water tank, both the inlet and outlet disposed in a bottom wall of the expansion tank.

9. A water dispenser comprising:

a purified water storage tank;

a hot water tank disposed below the storage tank and communicating therewith for receiving water from the storage tank and heating that water;

a cold water tank disposed below the storage tank and communicating therewith for receiving water from the storage tank and cooling that received water;

a dispensing structure communicating with the hot and cold water tanks for dispensing water therefrom;

a water level detector for maintaining a water level at a predetermined first elevation in the storage tank; and an expansion tank for discharging excess water, said expansion tank having an inlet communicating with the hot water tank for receiving excess water therefrom, and a discharge outlet communicating with the inlet for discharging the excess water from the expansion tank, the inlet situated at a second elevation disposed above the first elevation, whereby excess water disposed in the storage tank above the second elevation forces water to flow from hot water tank and through the expansion tank, wherein the hot water tank communicates with the inlet of the expansion tank by a conduit extending from a top wall of the hot water tank.

* * * * *